US005294027A

United States Patent [19]

Plastina

[11] Patent Number: 5,294,027

[45] Date of Patent: Mar. 15, 1994

[54] PORTABLE COMBINATION TABLE TOP/BASKET APPARATUS

[75] Inventor: Armando N. Plastina, Santa Cruz, Calif.

[73] Assignee: Bel-Art Products, Inc., Pequannock, N.J.

[21] Appl. No.: 22,532

[22] Filed: Feb. 25, 1993

[51] Int. Cl.[5] ..... A61G 5/02; A47C 7/68

[52] U.S. Cl. ..... 224/42.45 R; 224/901; 224/42.01; 224/275; 280/304.1; 220/6

[58] Field of Search ..... 224/275, 42.01, 42.45 R, 224/901; 280/304.1; 220/6, 7

[56] References Cited

U.S. PATENT DOCUMENTS

| | | | |
|---|---|---|---|
| 4,484,755 | 11/1984 | Houston | 280/304.1 X |
| 4,632,451 | 12/1986 | Lee | 280/304.1 X |
| 4,659,099 | 4/1987 | Malone | 280/304.1 |
| 4,775,069 | 10/1988 | Stonier | 220/6 |
| 4,867,506 | 9/1989 | Chavez | 280/304.1 X |
| 5,038,953 | 8/1991 | Radar | 220/6 |
| 5,190,179 | 3/1993 | Richter et al. | 220/6 |
| 5,228,711 | 7/1993 | Summers | 280/304.1 |

*Primary Examiner*—Ernest G. Cusick
*Attorney, Agent, or Firm*—Anthony F. Cuoco

[57] ABSTRACT

A base is mounted to a frame and a pair of foldable basket sides are mounted to the base and to a rim above the base. A pair of basket ends are displaceably mounted the rim. The sides are folded and the ends are displaced to an upright position to cooperate with the base and the rim for forming a rigid basket. The sides are folded and the ends are displaced so that the rim is adjacent the frame, whereby the rim receives a flat surface so as to render the apparatus in a table top configuration. Legs are provided for clamping the apparatus to supporting bars on a wheelchair or like equipment, whereby the independence, productivity and comfort of a user in a variety of environments is maximized.

6 Claims, 4 Drawing Sheets

PORTABLE COMBINATION TABLE TOP/BASKET APPARATUS

BACKGROUND OF THE INVENTION

This invention relates to apparatus which functions as a table top and a basket and, more particularly, to apparatus of the type described which is mountable to a wheelchair or the like.

It is important for those who are confined to wheelchairs or the like to maximize their independence, productivity and comfort at the workplace, school, and in and around their homes. The present invention achieves this purpose by providing portable, strong and lightweight apparatus which functions as a table top and a basket while featuring the convenience of easy storage and handling. The apparatus is in compact form and permits freedom of a user's hands to propel and maneuver a wheelchair, as the case may be. The apparatus makes efficient use of space without impairing the user's mobility in tight spaces and may be operated by those with limited hand dexterity. The device has adjustable features, as are desireable for the purposes intended. Thus, apparatus is provided which is usable in combination as, for example, a writing and eating surface and as a basket for carrying a variety of items so as to facilitate life for those who are confined as aforenoted.

SUMMARY OF THE INVENTION

This invention contemplates portable combination table top/basket apparatus including a frame having top and bottom surfaces. A base having top and bottom surfaces is mounted at its bottom surface to the top surface of the frame and a pair of parallel longitudinally extending foldable basket sides are hingedly mounted to the top surface of the base and to a rim above the base. The sides have upper and lower portions hingedly mounted to each other. A pair of basket ends are hingedly mounted to the rim. The arrangement is such that the sides are foldable and the ends are displaceable away from and toward the top surface of the base. When the apparatus is in a basket configuration, the sides are folded to an upright position and the ends are displaced to an upright position to form, with the base and the rim, a rigid basket for carrying a variety of items. When the apparatus is in a portable/storage or table type configuration, the sides are folded adjacent the top surface of the base whereby the rim is adjacent the top surface of the frame and the ends are displaced parallel to the rim. A flat surface such as, for example, for writing or eating is removably disposed within the rim on top of the displaced ends when the apparatus is in the table top configuration.

The bottom surface of the frame supports legs which are displaceable from a position adjacent the bottom surface of the base to a locked upright position for clamping the apparatus to utilizing equipment such as a wheelchair or the like. The apparatus is adjustable to provide versatility in use.

BRIEF DESCRIPTION OF THE DRAWINGS

FIG. 1 is an isometric representation showing the invention in a basket configuration and arranged for mounting to a wheelchair or the like.

DETAILED DESCRIPTION OF THE INVENTION

Figure 2:
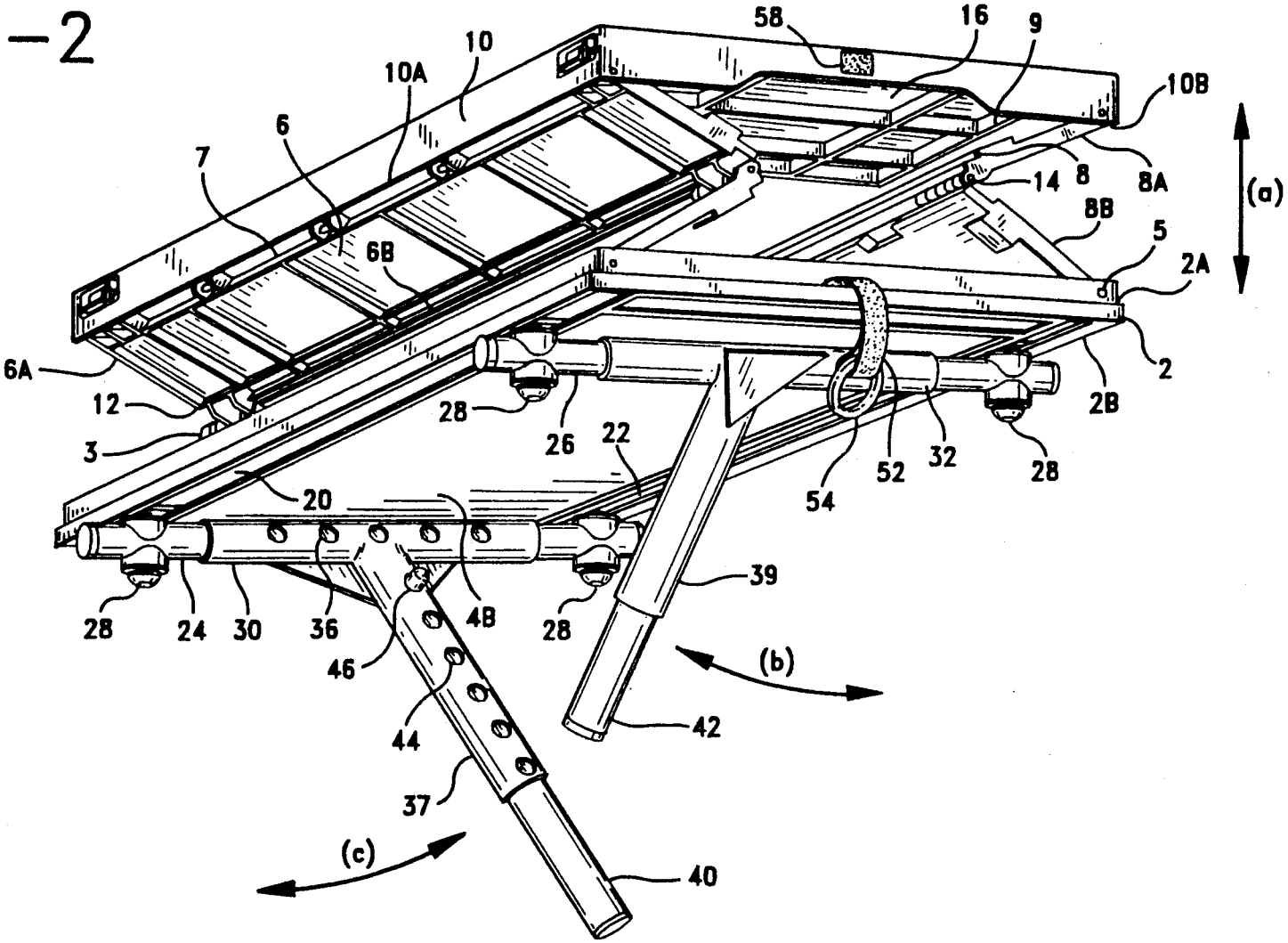
FIG. 2 is an isometric representation showing the foldable features of the invention.
Figure 3:
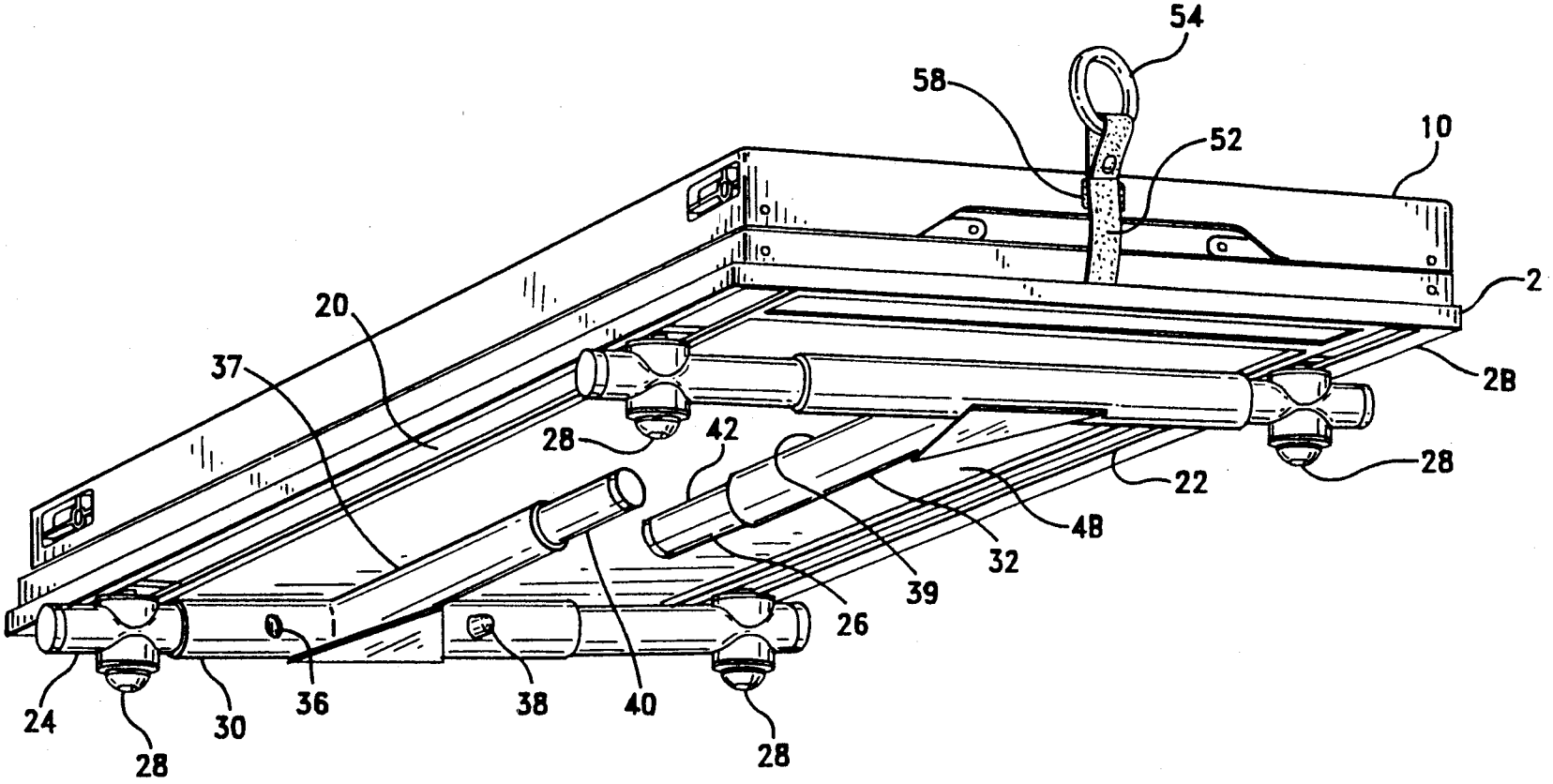
FIG. 3 is an isometric representation showing the invention in a fully folded position and wherein the invention is in a storage or portable configuration.

The apparatus of the invention includes a rectangular frame 2 and a rectangular base 4 secured thereto. Base 4 has a top surface 4A (FIG. 4) and a bottom surface 4B (FIGS. 1, 2 and 3).

Frame 2 has a top surface 2A and a bottom surface 2B and has attached to the top surface thereof a pair of longitudinally extending sides 6 and 8, and which sides 6 and 8 are in parallel spaced relation. Side 6 includes an upper portion 6A and a lower portion 6B and side 8 includes an upper portion 8A and a lower portion 8B. Lower portions 6B and 8B of sides 6 and 8, respectively, are hingedly attached to the top surface of frame 2 via hinge arrangements 3 and 5, respectively. Upper portions 6A and 8A of sides 6 and 8, respectively, are hingedly attached via hinge arrangements 7 and 9, respectively, to the respective longitudinally extending edges 10A and 10B of a rim 10 which is disposed above upper surface 4A of base 4.

Upper and lower portions 6A and 6B of side 6 are hingedly attached via a hinge arrangement 12 and upper and lower portions 8A and 8B of side 8 are hingedly attached via a hinge arrangement 14. The arrangement is such that side 6, including upper and lower portions 6A and 6B, is foldable away from and toward top surface 4A of base 4 as particularly shown in FIG. 2, and side 8 including portions 8A and 8B is foldable away from and toward top surface 4A of base 4 as also shown in FIG. 2. With the arrangement described, rim 10 is displaced either upwardly or downwardly in the directions shown by arrow (a) when sides 6 and 8 are folded as aforenoted.

Figure 1:
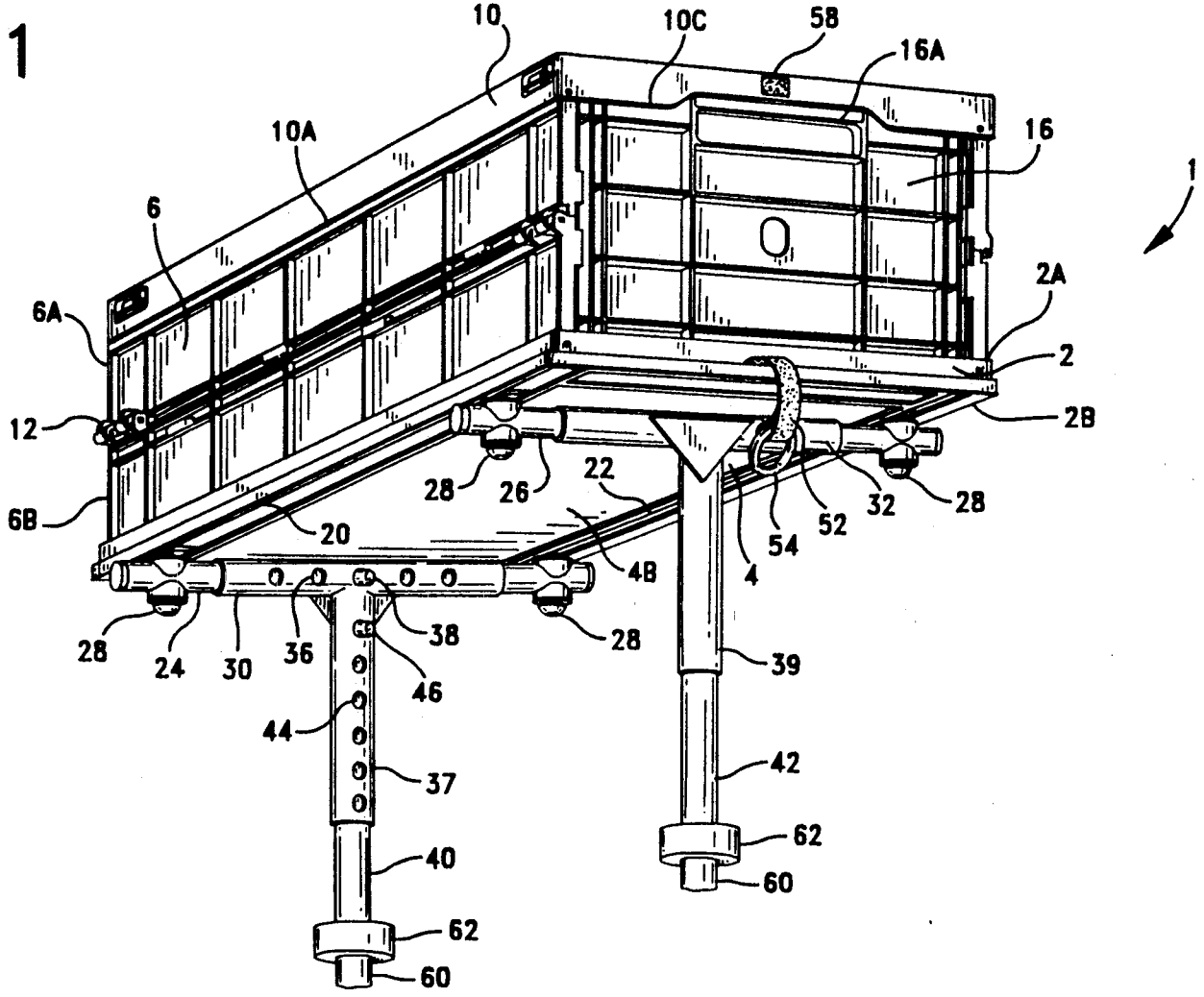
Figure 4:
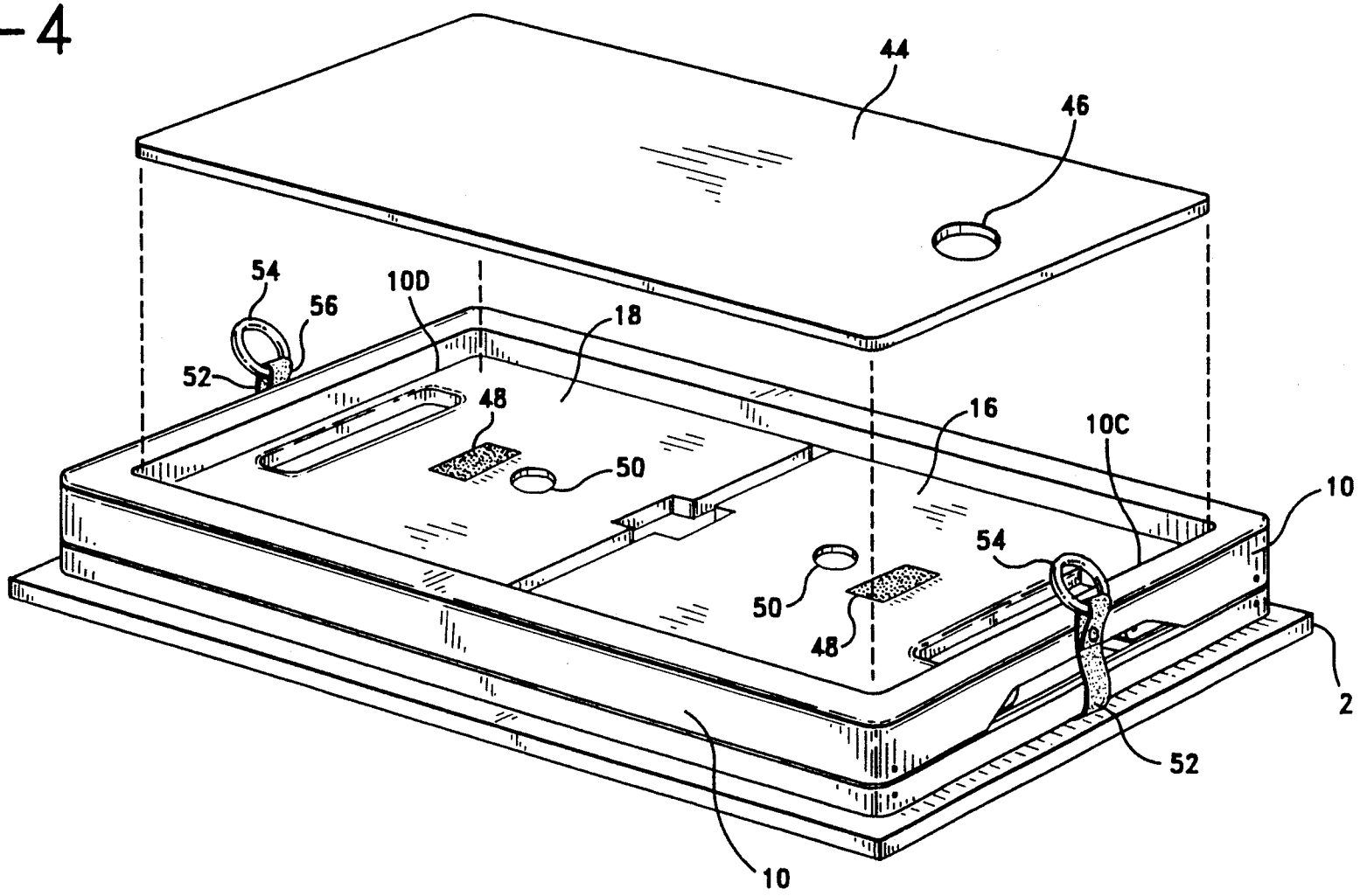
FIG. 4 is an isometric representation showing the invention in a table top configuration and showing a flat surface received within a rim thereof.

An end 16 is hingedly attached via a hinge arrangement 16A to a transversely extending end 10C of rim 10 as particularly shown in FIG. 1. An end 18 shown in FIG. 4 is hingedly attached to a transversely extending end 10D of rim 10 by a like hinge arrangement (not otherwise shown). The arrangement is such that ends 16 and 18 are displaceable away from and toward upper surface 4A of base 4.

It will be understood that when sides 6 and 8 are folded so as to be in the upright position and ends 16 and 18 are displaced so as to be likewise in the upright position and to thereby engage top surface 4A of base 4, a rigid basket 1 is provided in cooperation with the base and rim 10 as best illustrated in FIG. 1.

With particular reference to FIGS. 1, 2 and 3, bottom surface 2B of frame 2 has a pair of longitudinally extending parallel tracks 20 and 22. A pair of transversely extending bars 24 and 26 are positioned in tracks 20 and 22 via spring biased bolts such as 28. The arrangement is such that bars 24 and 26 are adjusted to a desired longitudinal spaced position in tracks 20 and 22 when bolts 28 are untightened and are thereafter secured in said adjusted position by tightening bolts 28 .

A sleeve 30 surrounds bar 24 and a sleeve 32 surrounds bar 26. The positions of sleeves 30 and 32 are transversely and rotatably adjustable along bars 24 and 26, respectively, via holes such as 36 in the sleeves and a spring loaded pin such as 38 in the bars as best shown in FIGS. 1 and 3. Holes 36 are arranged in longitudinally extending rows around the circumference of the sleeves to achieve the noted transverse and rotating adjustments.

Sleeves 30 and 32 have substantially centrally disposed sleeves 37 and 39 integral with and extending normal thereto. Legs 40 and 42 are disposed within sleeves 37 and 39, respectively. The length of legs 40 and 42 are adjustable within sleeves 36 and 38 via holes such as 44 in the sleeves and a spring loaded pin such as 46 in the bars as best shown in FIGS. 1 and 2.

It will now be discerned that sleeves 30 and 32 are rotatable around bars 24 and 26, respectively, so that legs 40 and 44 are displaceable away from and toward bottom surface 4B of base 4 as indicated by arrows (b) and (c) in FIG. 2.

Thus, sleeves 30 and 32 are transversely and rotatably adjusted relative to bars 24 and 26, respectively, and are locked in an adjusted position via spring loaded pin 38 engaging a hole 36 so that sleeve 37 and leg 40 and sleeve 39 and leg 42 are either parallel to bottom surface 4B of base 4 (FIG. 3) or are normal to bottom surface 4B (FIG. 1). The extension of legs 40 and 42 from the respective sleeves 37 and 39 is adjustable via spring pins 46 engaging holes 44. Legs 40 and 42 when so adjusted may be secured to supporting bars such as 60 on a utilizing apparatus such as a wheelchair or the like via suitable clamps such as 62 (FIG. 1), whereby the apparatus of the invention is supported for the purposes intended in either the table top or basket configuration as will now be appreciated.

FIG. 3 shows the apparatus of the invention in a portable or storage configuration. Thus, sides 6 and 8 are folded and ends 16 and 18 are displaced so that rim 10 is adjacent top surface 4A of base 4 (FIG. 4). Sleeves 37 and 39 carrying legs 40 and 42 are unlocked from the position shown in FIG. 1 and are rotated so as to be adjacent lower surface 4B of base 4, as particularly shown in FIG. 3 and locked in that position. In this regard, it will be discerned that sleeves 30 and 32 may be transversely adjusted and locked along bars 24 and 26 so that sleeves 37 and 39 carrying legs 40 and 42 do not interfere with each other when the legs are folded, again as particularly shown in FIG. 3.

FIG. 4 shows the apparatus of the invention in the table top configuration. The respective bars, sleeves and legs are not shown in FIG. 4 for purposes of simplifying the drawing but it will be understood that the configuration thereof is as illustrated and described with reference to FIGS. 1, 2 and 3.

With particular reference then to FIG. 4, a flat surface 44 is disposed within rim 10. Surface 44 has a finger hole or the like 46 to facilitate insertion and removal of surface 44 from the rim.

Ends 16 and 18 which have been displaced as aforenoted carry loop or pile members 48 on the exposed sides thereof. The underside of surface 44 carries meshing loop or pile members (not shown), whereby surface 44 is secured to displaced ends 16 and 18 for the purposes intended.

Ends 16 and 18 carry finger holes 50 to facilitate displacement of the ends as heretofore described.

Frame 2 carries straps 52, one on either end thereof, and which straps, in turn, carry finger loops 54. Straps 52 carry a loop or pile member such as 56 on the inner surface thereof and which loop or pile members 56 mesh with loop or pile members 58, particularly shown in FIGS. 1 and 2, whereby the apparatus is secured in the table top configuration shown in FIG. 4 or the storage configuration shown in FIG. 3. Finger loops 54 facilitate disengagement of straps 52 from members 58 whereby the apparatus can be converted from the table top or storage configuration to the basket configuration with relative ease, as will now be appreciated.

There has thus been described portable apparatus which functions as a table top and a basket and which is mountable to a wheelchair or the like so as to maximize the independence of the user. The adjustability as described renders the apparatus usable for a variety of users and adaptable for use with a variety of wheelchairs or like devices, as the case may be.

With the above description of the invention in mind, reference is made to the claims appended hereto for a definition of the scope of the invention.

What is claimed is:

1. Portable combination table top/basket apparatus, comprising:

a frame having top and bottom surfaces;

a base having top and bottom surfaces and mounted at its bottom surface to the top surface of the frame;

a rim above the base;

a pair of parallel, longitudinally extending foldable basket sides hingedly mounted to the top surface of the base and to the rim above the base and foldable away from and toward the top surface of the base;

a pair of basket ends hingedly mounted to the rim and displaceable away from and toward the top surface of the base;

the apparatus being in a basket configuration when the sides are folded to an upright position and the ends are displaced to an upright position to form in cooperation with the base and the rim a rigid basket;

the apparatus being in a portable and table top configuration when the sides are folded adjacent the top surface of the base and the ends are displaced parallel to the rim, whereby the rim is adjacent the top surface of the base;

the bottom surface of the frame supporting legs which are displaceable from a locked position adjacent the bottom surface of the base to a locked position normal to said base bottom surface, whereupon said legs are clampable to utilizing equipment;

a flat surface supported by the rim adjacent the displaced ends when the apparatus is in the table top configuration; and means for securing the flat surface to the rim including the exposed sides of the folded ends each carrying a loop member or a pile member, and the underside of the flat surface carrying loop or pile members which engage the loop or pile members on the exposed sides of the folded ends to secure the flat surface to the rim.

2. Apparatus as described by claim 1, wherein:

each of the pair of parallel, longitudinally extending foldable basket sides has an upper portion and a lower portion; and said upper and lower portions are hingedly attached to each other.

3. Portable combination table top/basket apparatus, comprising:

a frame having top and bottom surfaces;

a base having top and bottom surfaces and mounted at its bottom surface to the top surface of the frame;

a rim above the base;

a pair of parallel, longitudinally extending foldable basket sides hingedly mounted to the top surface of the base and to the rim above the base and foldable away from and toward the top surface of the base;

a pair of basket ends hingedly mounted to the rim and displaceable away from and toward the top surface of the base;

the apparatus being in a basket configuration when the sides are folded to an upright position and the ends are displaced to an upright position to form in cooperation with the base and the rim a rigid basket;

the apparatus being in a portable and table top configuration when the sides are folded adjacent the top surface of the base and the ends are displaced parallel to the rim, whereby the rim is adjacent the top surface of the base;

the bottom surface of the frame supporting legs which are displaceable from a locked position adjacent the bottom surface of the base to a locked position normal to said base bottom surface, whereupon said legs are clampable to utilizing equipment;

the bottom surface of the frame having a pair of longitudinally extending parallel tracks; and a pair of transversely extending bars are adjustably positioned within the tracks, whereby the longitudinal spaced relation between the bars is adjustable.

4. Apparatus as described in claim 3, including:

a pair of sleeves, each of which surrounds one of the bars so that the sleeves are rotatably and transversely adjustable relative to the bars;

means arranged with the bars and the surrounding sleeves for locking the bars in the sleeves in a transversely adjusted position; and means arranged with the bars and the surrounding sleeves for locking the bars in the sleeves in a rotatably adjusted position.

5. Apparatus as described by claim 4, including:

each of the pair of sleeves having a substantially centrally disposed sleeve integral therewith and extending normal thereto;

a leg adjustably disposed within each of said normally extending sleeves; and means arranged with the legs and the normally extending sleeves for locking the legs in said sleeves in a longitudinally extended position when the sleeves surrounding the bars are rotated to an adjusted position normal to the bottom surface of the base and are locked in said position.

6. Portable combination table top/basket apparatus, comprising:

a frame having top and bottom surfaces;

a base having top and bottom surfaces and mounted at its bottom surface to the top surface of the frame;

a rim above the base;

a pair of parallel, longitudinally extending foldable basket sides hingedly mounted to the top surface of the base and to the rim above the base and foldable away from and toward the top surface of the base;

a pair of basket ends hingedly mounted to the rim and displaceable away from and toward the top surface of the base;

the apparatus being in a basket configuration when the sides are folded to an upright position and the ends are displaced to an upright position to form in cooperation with the base and the rim a rigid basket;

the apparatus being in a portable and table top configuration when the sides are folded adjacent the top surface of the base and the ends are displaced parallel to the rim, whereby the rim is adjacent the top surface of the base;

the bottom surface of the frame supporting legs which are displaceable from a locked position adjacent the bottom surface of the base to a locked position normal to said base bottom surface, whereupon said legs are clampable to utilizing equipment;

straps mounted to each of the ends of the frame;

each of the straps carrying a loop member or a pile member on an inside surface thereof;

each of the ends of the rim carrying loop or pile members which engage the loop or pile members carried on the inside surfaces of each of the straps, whereby the apparatus is secured in the portable and tabletop configuration; and the apparatus being convertible to the basket configuration when the loop or pile members carried on the inside surface of each of the straps are disengaged from the loop or pile members carried on each of the ends of the rim.

* * * * *